United States Patent [19]

Fujita

[11] Patent Number: 4,755,852

[45] Date of Patent: Jul. 5, 1988

[54] EXPOSURE CONTROL DEVICE FOR A COPIER

[75] Inventor: Hiroshi Fujita, Yamatokoriyama, Japan

[73] Assignee: Sharp Kabushiki Kaisha, Osaka, Japan

[21] Appl. No.: 21,648

[22] Filed: Mar. 4, 1987

[30] Foreign Application Priority Data

| | | | |
|---|---|---|---|
| Mar. 5, 1986 | [JP] | Japan | 61-47951 |
| Nov. 28, 1986 | [JP] | Japan | 61-284886 |
| Nov. 29, 1986 | [JP] | Japan | 61-285118 |

[51] Int. Cl.[4] ..... G03G 15/00

[52] U.S. Cl. ..... 355/14 E; 355/14 R

[58] Field of Search ..... 355/3 CH, 3 R, 14 E, 355/14 CH, 14 R

[56] References Cited

U.S. PATENT DOCUMENTS

| | | | |
|---|---|---|---|
| 4,200,391 | 4/1980 | Sakamoto et al. | 355/14 E |
| 4,239,374 | 12/1980 | Tatsumi et al. | 355/14 E |
| 4,306,804 | 12/1981 | Sakamoto et al. | 355/14 E |
| 4,624,548 | 11/1986 | Takayanagi | 355/14 E X |
| 4,640,603 | 2/1987 | Honma | 355/3 R |
| 4,647,184 | 3/1987 | Russell et al. | 355/14 C |
| 4,659,209 | 4/1987 | Yamada | 355/14 E |

*Primary Examiner*—A. C. Prescott

*Attorney, Agent, or Firm*—Flehr, Hohbach, Test, Albritton & Herbert

[57] ABSTRACT

An exposure control device for a copier includes a microcomputer which automatically varies the exposure sequentially in a stepwise fashion and the copier performs copying operation in correspondence with the timing of this variation in exposure. The user has only to press a print button once to obtain a copy or copies with exposure changed in stepwise fashion.

3 Claims, 8 Drawing Sheets

EXPOSURE CONTROL DEVICE FOR A COPIER

BACKGROUND OF THE INVENTION

This invention relates to a copier with an automatic exposure control device such that copies with optimum image density can be easily obtained and more particularly to such an exposure control device which varies the exposure in a stepwise fashion to achieve proper exposure.

Since situations occur frequently where the user of a copier wishes to vary light exposure according to the density and kind of the original document to be copied, there have been many copiers developed with various exposure selecting means. With a copier of this type, the user usually presses a print button a number of times to actually obtain copies with different exposures and selects the best one of these many copies having different image densities.

There have also been developed copiers with an automatic exposure control device with which the density of the original document to be copied is automatically detected and the level of exposure is automatically adjusted according to the detected density. Such copiers cannot function properly, however, if the density varies radically, for example, from one end of a document to the other. In such a situation, exposure must be varied manually in a stepwise fashion as explained above. It now goes without saying that it is extremely inconvenient if the user is required to press the print button many times while varying exposure. Some copiers with an automatic density detecting means are also provided with a sensitivity setting means for setting the relationship between the output from the density detecting means indicative of the density of the document to be copied and the exposure to be given to the photoreceptor of the copier. With such a copier, a test document or a document with a standard reference density is provided and a proper level of exposure sensitivity is set by copying such a document. With such copiers, too, the user is required to experiment many times with the adjustment of sensitivity by actually making copies of such a test document.

SUMMARY OF THE INVENTION

It is therefore an object of the present invention to provide an exposure control device for a copier with which the user needs only to press the print button once to automatically obtain copies with exposure varied in a stepwise fashion.

It is another object of the present invention to provide a copier with which the user can determine and set the optimum exposure sensitivity by only one copying operation instead of repeating adjustments and testing many times.

The above and other objects are achieved in one aspect of the present invention by providing an exposure control device for a copier which comprises, in addition to exposure selecting means for specifying exposure in a stepwise fashion and exposure adjusting means for adjusting exposure by an optical system in response to a signal from the aforementioned exposure selecting means, exposure varying means for automatically varying the exposure by the optical system sequentially and in a stepwise fashion and control means for controlling the copying operation of the copier corresponding to the timing of the changes in exposure by the aforementioned exposure varying means. The aforementioned control means may be so programmed as to produce only one sheet of copy as the exposure is changed in its full range by the exposure varying means or to produce a copy for each change of exposure. It goes without saying that the stepwise variation of exposure by the exposure varying means may be effected on the same levels as that by the aforementioned exposure selecting means or independently thereof.

In another aspect, the present invention discloses a copier which comprises mode switching means for switching to a test mode of operation by operating a specified key and sensitivity switching means for controlling sensitivity setting means during a series of copying operations on one or more sheets in the test mode of operation to sequentially change the sensitivity in a plurality of steps. With a copier thus comprised, a single document is copied in a test mode of operation on one or more copy sheets with stepwise varied levels of sensitivity. The user can determine from the result thus obtained an area which is optimally exposed and ascertain the optimum sensitivity from its position.

Alternatively, the copier may be provided with means for varying exposure nearly continuously between a minimum value and a maximum value while a copying operation is effected on one sheet of copy paper in the test mode of operation. With a copier thus comprised, an original document is copied onto a single sheet of copy paper while exposure is varied nearly continuously between a minimum value and a maximum value. The user can again identify an optimally exposed area on the copy and ascertain the optimum condition of exposure.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
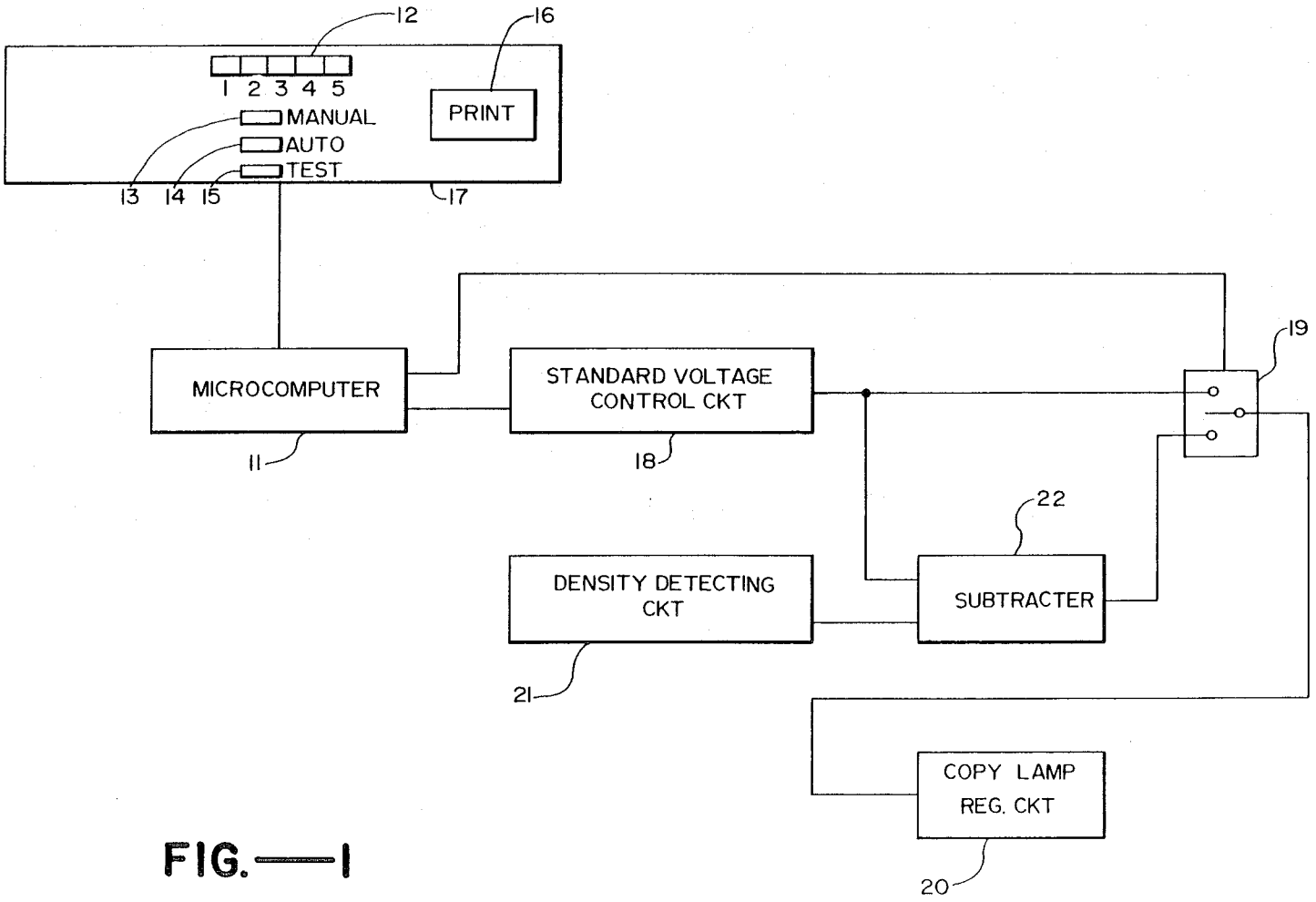
FIG. 1 is a block diagram schematically showing the control circuit of an exposure control device according to an embodiment of the present invention.

With reference to FIG. 1 which is a block diagram of a control circuit embodying the present invention, numeral 11 indicates a microcomputer which is operated according to programs for functions of exposure varying means and copying control means. On the input side of this microcomputer 11, there is connected thereto a control panel 17 with various keys and buttons including five exposure selecting buttons 12 with which exposure can be set in five different steps 1 through 5, a MANUAL button 13 for transmitting a command that exposure is going to be controlled manually, an AUTO button 14 for transmitting another command that exposure is going to be controlled automatically, a TEST button 15 for causing the microcomputer 11 to perform the aforementioned functions of exposure varying means and copying control means, and a PRINT button 16 for causing the copier to carry out a copying operation. Connected to the output port of the microcomputer 11 is a standard voltage control circuit 18 for applying to the optical system (not shown) of the copier a standard voltage corresponding to the level of exposure set in a stepwise fashion by one of the exposure selecting buttons 12. This standard voltage control circuit 18 is connected to a copy lamp control circuit 20 through a circuit changing switch 19.

Numeral 21 indicates a density detecting circuit which is adapted to transmit an output signal indicative of the density of an original document to be copied detected by a phototransistor or an image sensor (not shown) of a known kind. The standard voltage control circuit 18 and the density detecting circuit 21 are both connected to a subtracter circuit 22 and the difference between the outputs from the standard voltage control circuit 18 and the density detecting circuit 21 is also transmitted to the copy lamp control circuit 22 through the circuit changing switch 19. The output port of the microcomputer 11 is also connected to the circuit changing switch 19 directly and connects the copy lamp control circuit 20 either to the standard voltage control circuit 18 or to the density detecting circuit 21 according to its program.

Figure 2:
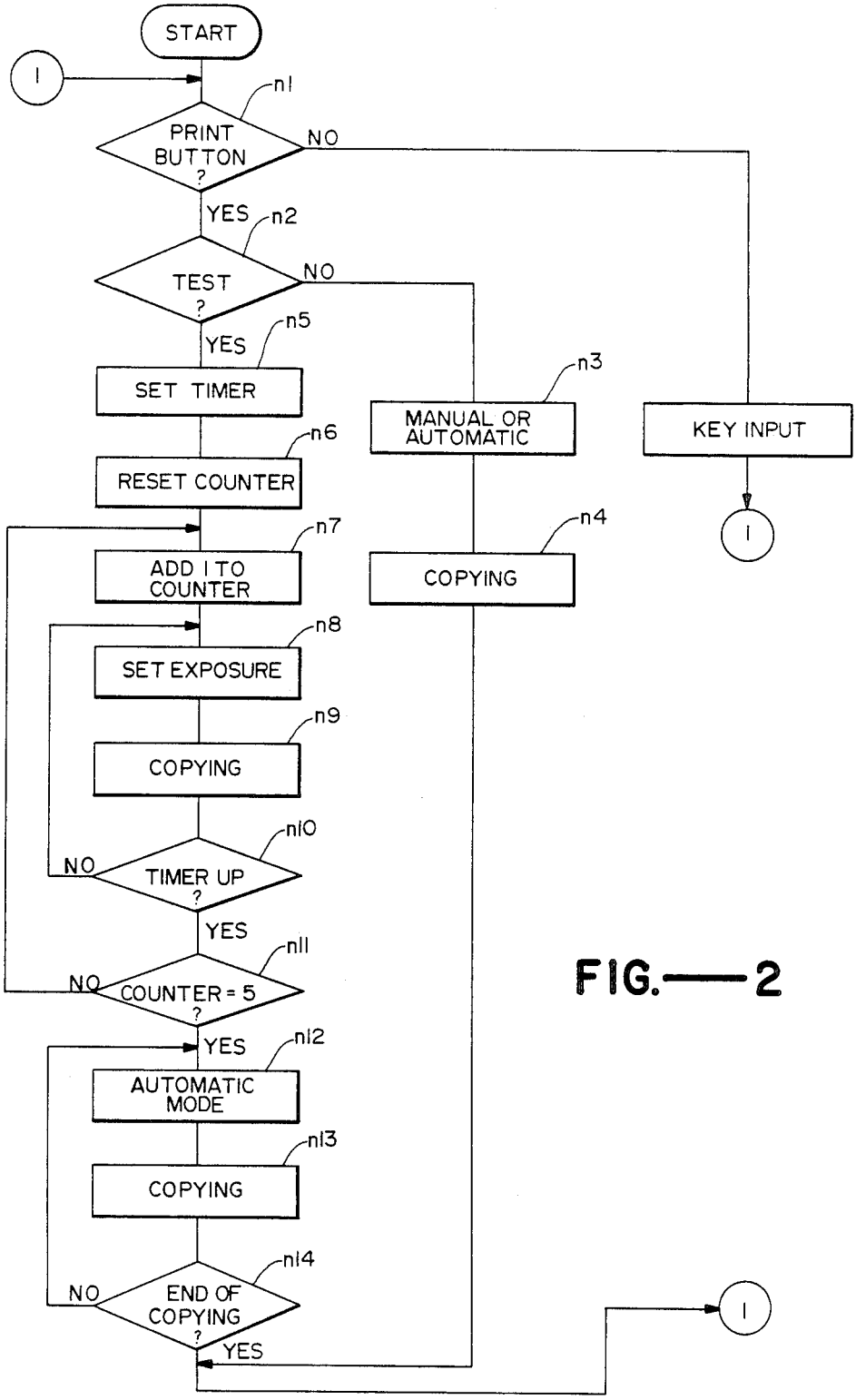
FIG. 2 is a flow chart for the operation of the control circuit shown in FIG. 1.

Next, the flow chart shown in FIG. 2 is referenced to explain a program for the operation of the control circuit of FIG. 1 whereby copying with varied levels of exposure is effected on a single sheet of copy paper. When the PRINT button 16 is pressed by the user (YES in n1), the circuit determines whether the TEST button 15 has been pressed or not (n2). If the TEST button 15 has not been pressed, the exposure is adjusted either according to the exposure selecting button 12 pressed by the user (manual mode of operation) or automatically according to the density of the original document to be copied detected by the density detecting circuit 21 (automatic mode of operation) (n3) and copying is carried out with the level of exposure thus determined (n4). If it is determined in Step n2 that the TEST button 15 has been pressed, a software timer is set (n5) by dividing by an appropriate number the time required for completing the copying of the original document which is set to be copied and of which the size is known. If the same variations in exposure as are possible by operating the aforementioned five exposure selecting buttons 12 are desired, for example, the divider is selected to be $5+1=6$. The addition of 1 is required if it is also desired to obtain an image by the so-called automatic exposure.

After the timer is thus set, a counter for counting the number of stepwise variations in exposure is reset to 0 (n6) and 1 is then added to this counter (n7). Thereafter, the microcomputer 11 operates the circuit changing switch 19 to the side of the standard voltage control circuit 18 and transmits to the standard voltage control circuit 18 a value signal indicative of the level of exposure corresponding to the value in the counter. In response, the standard voltage control circuit 18 transmits through the circuit changing switch 19 to the copy lamp control circuit 20 a signal indicative of the aforementioned level of exposure (n8) and copying is effected thereafter (n9).

This copying process lasts for a time period set by the timer in Step n5. At the end of this time period (YES in n10), the content of the counter is again increased by 1 (n7) if the maximum value (5 in this example because there are five exposure selecting buttons 12) has not been reached (NO in n11) and Steps n7 to n11 are repeated. This is equivalent to copying the document by changing the exposure five times in a stepwise fashion.

After the exposure has been varied the maximum number of times (YES in n11), the microcomputer 11 operates the circuit changing switch 19 to the side of the subtracter circuit 22 (n12). Thereafter, copying is resumed (n13) with the copy lamp controlled according to the density of the original document detected by the density detecting circuit 21. This is continued until the end of the cycle of copying operation for producing a copy on one sheet (n14).

If the aforementioned maximum value is 5, for example, the copy paper is divided into six areas in the direction in which it is transported, each area being exposed differently with the last area having an image obtained by automatic exposure adjustment mode of operation. Thus, the user can immediately determine visually which area has the best image density and select the exposure selecting button 12 corresponding to the image thus selected as the best. Thereafter, the user can obtain the optimum image density by carrying out the copying operation manually. In summary, the user makes two copies to obtain one most appropriately exposed image.

A program of operation has been described above for an exemplary situation where five exposure selecting buttons 12 are provided such that the user can vary the exposure in five levels. If the copier is provided with a continuously variable switch instead such that the exposure can be changed nearly continuously, the divider may be appropriately increased so that intermediate values can also be selected.

Figure 3:
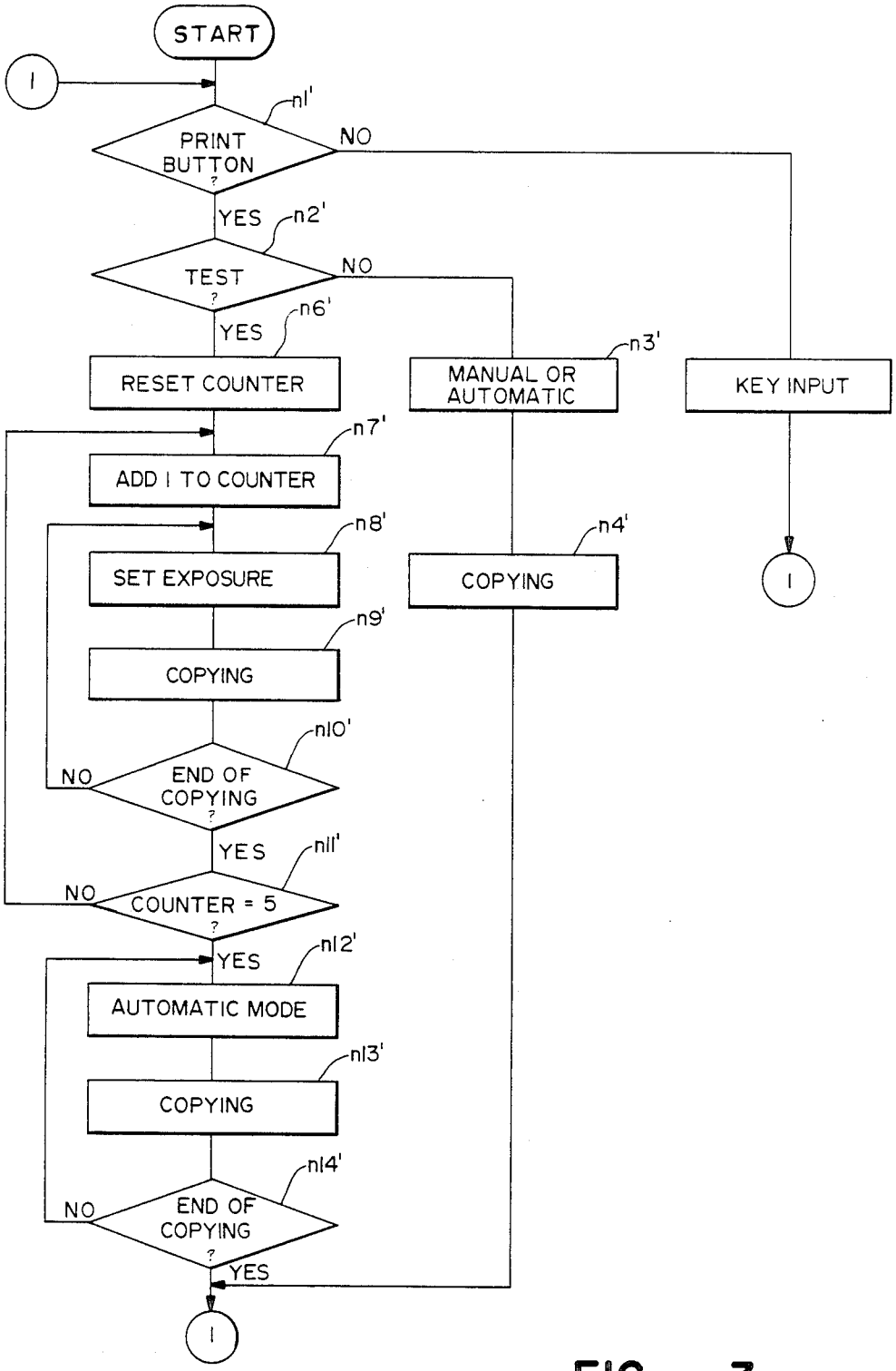
FIG. 3 is another flow chart for the operation of the control circuit shown in FIG. 1.

FIG. 3 is a flow chart for the operation of the control circuit shown in FIG. 1 according to another program whereby a new sheet of copy paper is used for each change in the exposure level. Since there is no need to divide each copy paper into areas in this program, there is no need for a timer. Thus, the flow chart of FIG. 3 is identical to that of FIG. 2 except Step n5 in deleted and Step n9 continues until the copying on this paper is completed. The other steps are therefore indicated by the same numerals in FIG. 3 and not separately explained. If the aforementioned maximum value is 5 as in the example considered above, six copy sheets are produced by this program and the user is again able to visually select the best exposure by comparing the produced copies. Steps n12 through n14 and n12' through n14' may be deleted from the flow charts of FIGS. 2 and 3 if the user so desires.

Figure 4:
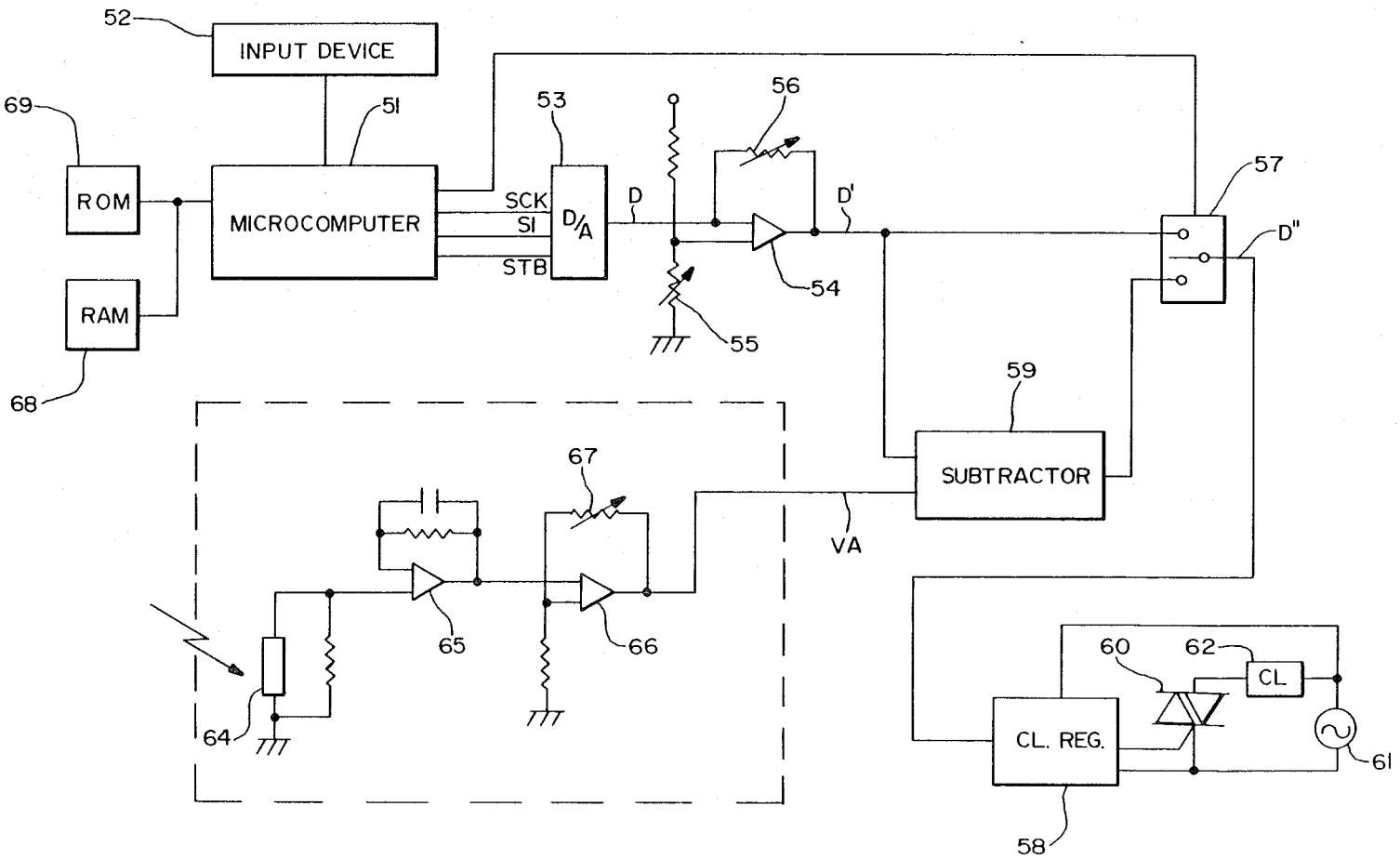
FIG. 4 is a circuit diagram of an exposure control device for a copier according to another embodiment of the present invention.

In FIG. 4 which is a circuit diagram of an exposure control device for a copier according to another embodiment of the present invention, numeral 51 indicates a microcomputer adapted to process data in units of 8 bits and numeral 52 generally indicates an input device for the copier and includes a PRINT key and a TEST key as explained above in connection with FIG. 1. The input data entered through these keys and/or buttons are received by the microcomputer 51. The program by which the microcomputer 51 controls the operation of the copier is already stored in ROM 19. RAM 18 is used as working areas for various flags and counters when the control program is executed.

Figure 5:
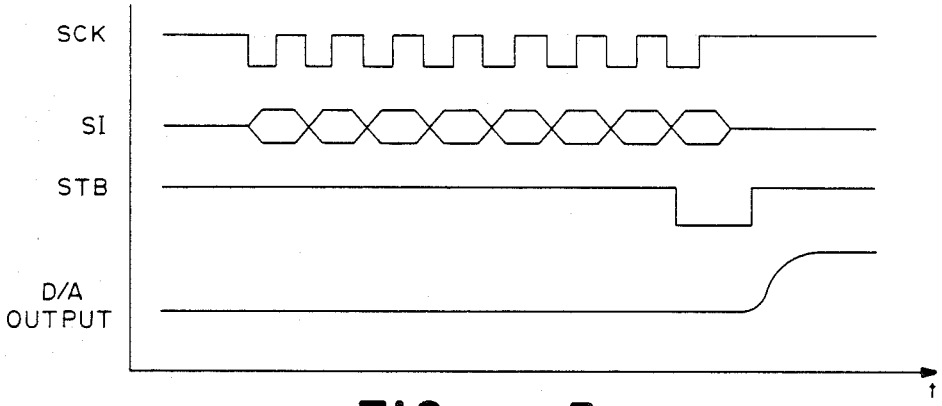
FIG. 5 is a time chart for explaining the transmission of exposure data from the microcomputer to the digital-to-analog converter of the exposure control device of FIG. 4.

The microcomputer 51 computes exposure data D on the basis of the entries from the input device 52. The exposure data D is an 8-bit data and can be set in 256 steps from 0 to 255. The exposure data D calculated by the microcomputer 51 is serially received by a digital-to-analog converter 53 which converts the digital exposure data D into an analog exposure data D. FIG. 2 is a time chart showing this serial transmission of exposure data D. With reference to FIG. 5, the microcomputer 51 transmits to the digital-to-analog converter 53 not only a clock pulse SCK but also the exposure data D as 8-bit serial data SI, and the digital-to-analog converter 53 latches the serial data SI for each rise of the clock pulse SCK. Right after the eighth serial data SI becomes effective, the microcomputer 51 transmits a strobe pulse STB and the digital-to-analog converter 53 transmits the analog exposure data D at the rise of this strobe pulse STB.

With reference again to FIG. 4, numeral 54 indicates an operational amplifier which receives the exposure data D and transmits exposure data D' given by $V_0+Di$ where $V_0$ is a lower limit value determined by a resistor 55 and i is a constant adjustably determined by another resistor 56. Numeral 57 indicates an analog switch and serves to transmit the exposure data D' by a signal from the microcomputer 51 directly to a copy lamp regulating circuit 58 in the case of manual mode of operation and through a subtracter circuit 59 to the copy lamp regulating circuit 58 in the case of automatic mode of operation. The copy lamp regulating circuit 58 regulates the brightness of a copy lamp 62 through the phase control of an AC power source 61 by triggering a triac 60. The copy lamp regulating circuit 58 also serves to safeguard against voltage variations of this power source 61 such that the exposure can be maintained always at a constant level.

Numeral 63 generally indicates a density detecting circuit for detecting the density of an original document to be copied. Numeral 64 indicates a photosensor for detecting the intensity of the reflected light from the original document. The photosensor 64 is adapted to output a voltage proportional to the amount of light received thereby. Numeral 65 indicates an operational amplifier which serves as a buffer and numeral 66 indicates another operational amplifier which amplifies the output from the photosensor 64 through the operational amplifier 65 and thereby outputs document density data $V_A$. Numeral 67 indicates a resistor for adjusting the amplification of the operational amplifier 66 such that the difference in voltage applied to the copy lamp 62 when a black original document is used and when a white original document is used with the same exposure data D will take upon an appropriate value.

The aforementioned document density data $V_A$ is transmitted together with the exposure data D' to the subtractor circuit 59 in the case of automatic mode of operation. The subtractor circuit 59 serves to modify the exposure data D' by the document density data $V_A$ and transmits exposure data D'' given by $V_0+Di-V_A$ to the copy lamp regulating circuit 58. Thus, $V_A$ becomes greater where the original document to be copied is brighter. This makes $(V_0+Di-V_A)$ smaller and the exposure becomes weaker, thereby accomplishing the objective of automatic exposure. In the case of manual mode of operation, on the other hand, the aforementioned value D represents the level of exposure such that exposure is uniquely determined if this value is set. In the case of automatic exposure, the value of D serves to shift the level of exposure as a whole and this value changes when exposure sensitivity is set.

Figure 7:
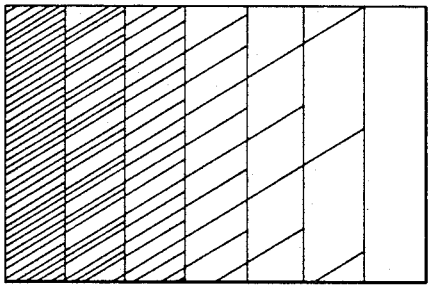
FIG. 7 is a schematic drawing showing a copy obtained in the test mode of operation according to the flow chart of FIG. 6.
Figure 6:
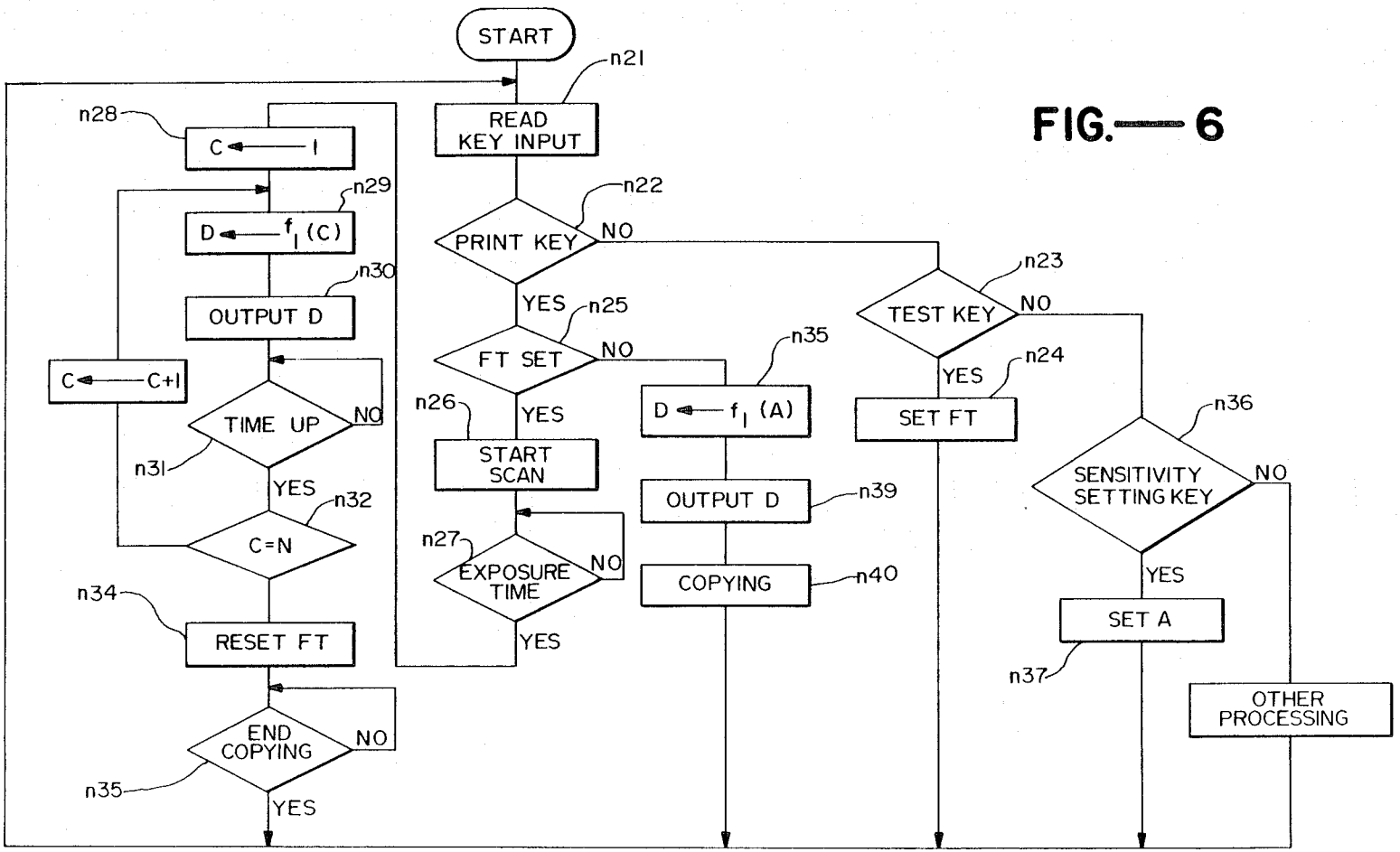
FIG. 6 is a flow chart for the operation of the microcomputer shown in FIG. 4 according to one embodiment of the present invention.

A program according to one embodiment of the present invention for the operation of the microcomputer 51 of FIG. 4 is shown by a flow chart in FIG. 6. With reference next to this flow chart, the microcomputer 51 firstly receives data from the input device 52 (n21). If it is found that the key which has been operated is the TEST key (YES in n23), a test flag FT is set (n24). If the PRINT key is subsequently operated (YES in n22), the original document to be copied is scanned (n26) because the flag is in set condition (YES in n25). There is provided a counter C used as the indicator of exposure sensitivity which can be varied in a plurality of steps and when the time for starting exposure is reached (YES in n27), the counter C is set to 1 which serves as its initial value. Thereafter, the exposure data D corresponding to the current counter value C is computed according to a predefined functional relationship $f_1$ between D and C (n29), and the exposure value D thus computed is transmitted to the digital-to-analog converter 53, thereby setting the brightness of the copy lamp 62 (n30). Next, the system waits until a predetermined time period has elapsed (n31) to add 1 to the counter C (n33) unless the counter value C has reached a predefined maximum value N (NO in n32) and repeats Steps n30 and n31. The photoreceptor of the copier is thereby automatically exposed with N different levels of exposure sensitivity. When the counter C reaches the maximum value N, the test flag FT is reset (n34) and the copying operation is resumed until it is completed (n35). FIG. 7 shows schematically how a copy thus obtained by such a test mode of operation may appear when N=7. The user can determine the optimum exposure sensitivity from such a result and set its value by operating a sensitivity setting key (YES in n36) to store the selected exposure sensitivity A (n37).

If the PRINT key is operated in an ordinary mode of operation other than the test mode (NO in n25), copying is effected with the set exposure sensitivity A. In this situation, exposure data D corresponding to the exposure sensitivity A is computed from the aforementioned functional relationship $f_1$ therebetween (n38) and transmitted to the digital-to-analog converter 53 (n39) and ordinary copying is effected (n40).

Figure 8:
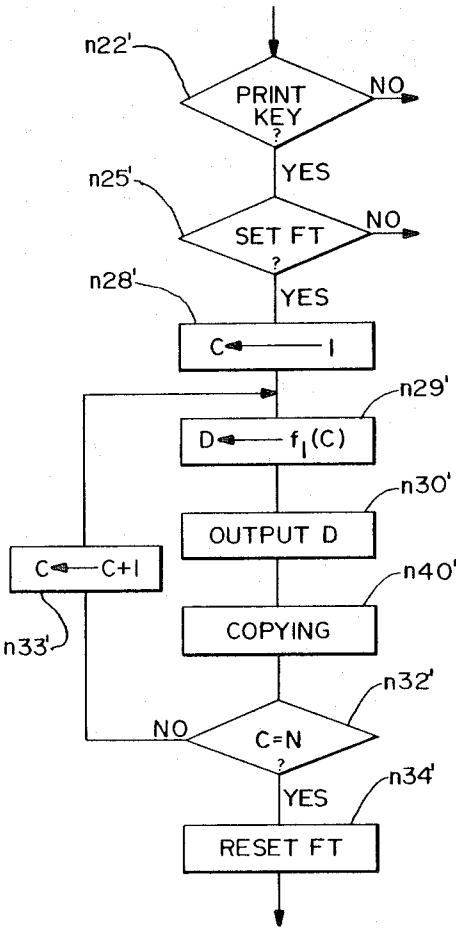
FIG. 8 is a portion of a flow chart for the operation of the microcomputer shown in FIG. 4 according to another embodiment of the present invention.

According to the control program described above by way of the flow chart shown in FIG. 6, a single sheet of copy paper is exposed while the exposure sensitivity is sequentially changed in a stepwise fashion. Alternatively, however the control program may be so structured that a different sheet of copy paper is used for exposure with each different level of sensitivity. A flow chart for such alternative program may be identical to that shown in FIG. 6 except Steps n22 through n34 are changed as shown in FIG. 8 wherein the steps which are similar or identical to those in FIG. 6 are indicated by the same numerals. After the PRINT key is operated (YES in n22' with reference to FIG. 8), the counter C is initialized (n28') if the test flag FT is set (YES in n25'), indicating the test mode of operation. Thereafter, the exposure data D is similarly obtained from the counter value C (n29') and then outputted to the digital-to-analog converter 23 (n30'). After the exposure data D is thus set, copying is effected on a single sheet (n40') with this exposure data D. Thereafter, the counter value C is incremented (n33') and next copying operation is effected with a different level of exposure sensitivity on another sheet of copy paper. When the counter value C has reached the preset maximum value N (YES in n32'), the test flag FT is reset (n34'). In this program, N sheets of copy paper are used, each one exposed at a different level of sensitivity.

With a copier programmed as described above, the user has only to operate a specified key to select a test mode of operation. Copying is thereby effected on a single sheet or a plurality of sheets of copy paper with stepwise varied levels of exposure sensitivity such that the user can easily select an optimum setting.

Figure 9B:
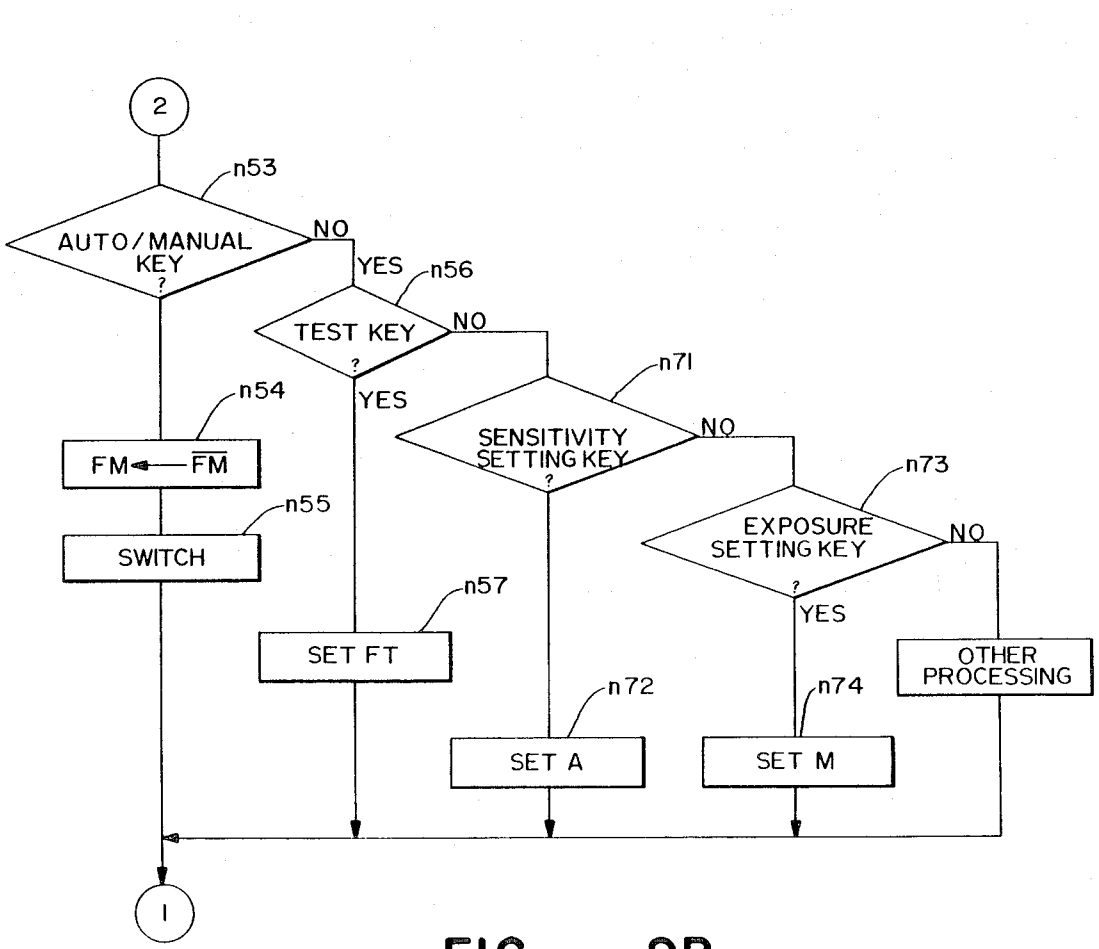
FIGS. 9A and 9B are a flow chart for the operation of the microcomputer shown in FIG. 4 according to still another embodiment of the present invention.
Figure 9A:
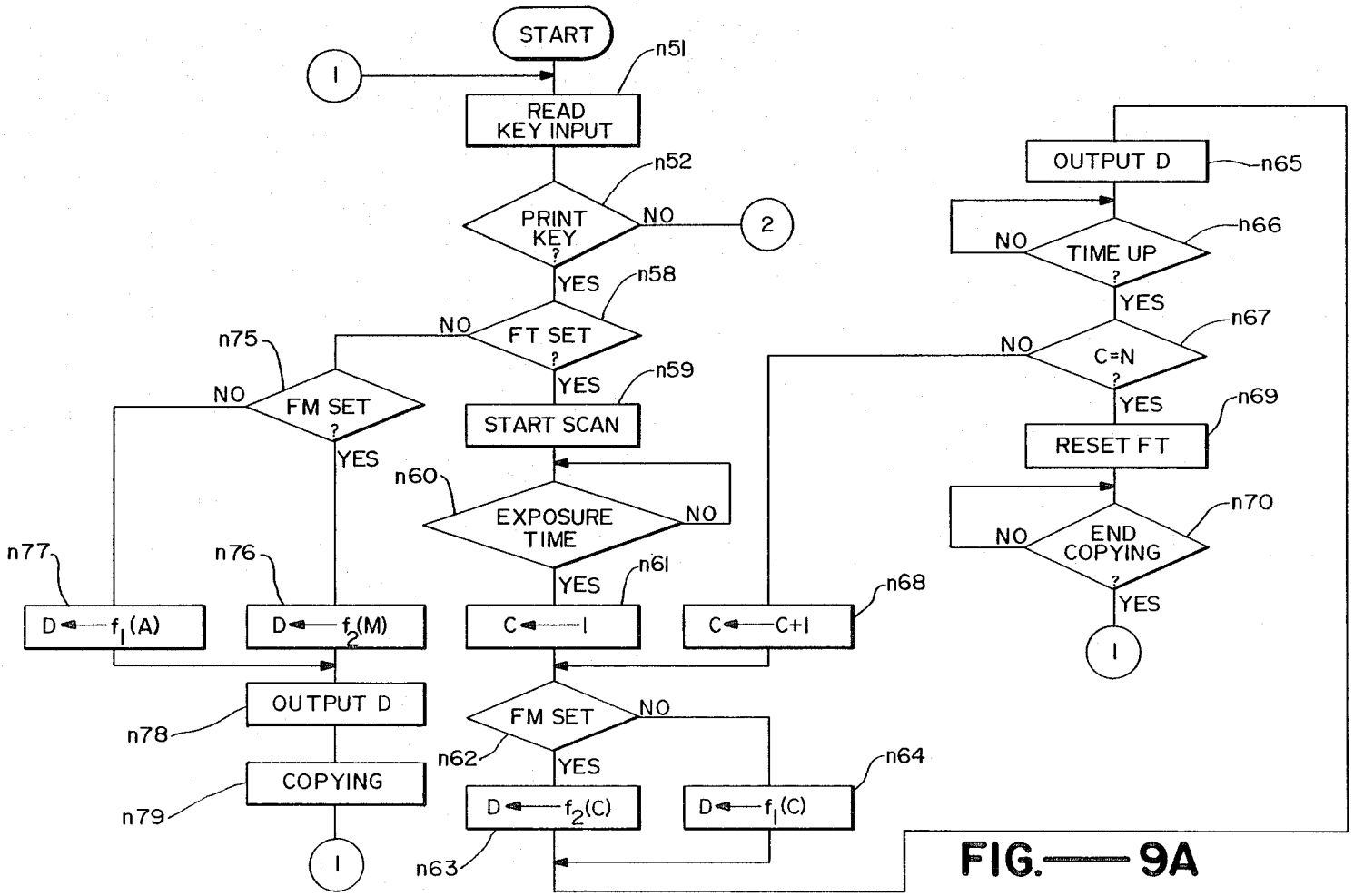

Still another program embodying the present invention according to which the microcomputer 1 of FIG. 4 may be operated is explained next by way of the flow chart shown in FIGS. 9A and 9B. The RAM 68 includes an auto/manual flag FM which indicates the manual mode of operation when it is set and the automatic exposure mode of operation when it is reset. After the key input through the input device 52 is read, if it is found that the key which has been operated is not the PRINT key (NO in n52) but the auto/manual key (YES in n53), the condition of the auto/manual flag FM is reversed (n54). Thereafter, the connection of the switch 57 is changed according to the condition of the auto/-manual flag FM such that the output of the subtracter circuit 59 is selected in the case of automatic exposure mode when the flag FM is reset and the output of the operational amplifier 54 is selected in the case of manual mode of operation when the auto/manual flag FM is set (n55).

Figure 10:
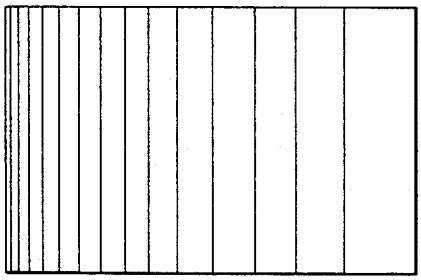
FIG. 10 is a schematic drawing showing an example of result of copying operation according to the flow chart of FIGS. 9A and 9B.

If the TEST key is operated (YES in n56) thereafter, the test flag FT is set (n57). If the PRINT key is subsequently operated (YES in n52), scanning of the original document to be copied is started (n59) because the test flag FT is then in the set condition (YES in n58). When a preset time period has elapsed for starting exposure (YES in n60), the counter C is initialized to 1 (n61). In this program, the counter values C are used in the manual mode of operation for indicating the steps in which exposure is varied and in the automatic exposure mode of operation for indicating the steps in which exposure sensitivity is varied. Thus, if the auto/manual flag FM is set, indicating the manual mode of operation (YES in n62), exposure data D is calculated from the counter value C by means of a predetermined functional relationship $f_2$ for the manual mode of operation (n63) and if the auto/manual flag FM is reset, indicating the automatic exposure mode of operation (NO in n62), exposure data D is calculated from the counter value C by means of another predetermined functional relationship $f_1$ for the automatic exposure mode of operation (n64). Thereafter, brightness of the copy lamp 62 is set by transmitting the exposure data D thus computed to the digital-to-analog converter 53 of FIG. 4 (n65). When another predetermined period of time has elapsed (YES in n66), the counter value C is incremented by 1 (n68) if it has not reached a predefined maximum value N (NO in n67), thereby changing the exposure condition and repeating Steps n62 through n66. In this manner, the photoreceptor of the copier is exposed under N different conditions. After exposure under all N conditions is completed (YES in n67), the test flag FT is reset (n69) and the copying operation is continued to the end of the process (n70). The result of such copying operation may look as shown in FIG. 10. The user can again determine from such a result the optimum exposure sensitivity and set the level of exposure in the case of manual mode of operation and the level of exposure sensitivity in the case of automatic exposure mode of operation. If the exposure setting key is thereafter operated (YES in n73), the selected level of exposure M is stored (n74). If the sensitivity setting key is operated instead (YES in n71), the selected level of exposure sensitivity A is stored (n72).

If the PRINT key is operated thereafter (YES in n52) in an ordinary mode other than the test mode of operation (NO in n58), exposure data D is computed from the selected level of exposure M (n77) in the case of manual mode of operation (YES in n75) and from the selected level of exposure sensitivity A (n77) in the case of automatic exposure mode of operation (NO in n75). The exposure data D thus computed is thereafter outputted to the digital-to-analog converter 53 (n78) to control the brightness of the copy lamp 62 and ordinary copying operation is performed thereafter under this condition (n79).

The foregoing description of preferred embodiments of the invention has been presented for purposes of illustration and description. It is not intended to be exhaustive or to limit the invention to the precise form disclosed. Modifications and variations which may be apparent to a person skilled in the art are intended to be included within the scope of this invention.

What is claimed is:

1. In an exposure control device for a copier comprising exposure selecting means for specifying exposure in steps, and exposure adjusting means for adjusting exposure by an optical system according to a signal from said exposure selecting means, the improvement wherein said exposure control device further comprises exposure varying means for automatically varying exposure by said optical system sequentially in a stepwise fashion, and operation controlling means for performing copying operation in correspondence with the timing of variation by said exposure varying means.

2. In a copier comprising a photoreceptor, document density detecting means for detecting the density of a document to be copied and transmitting a signal indicative of said detected density, sensitivity setting means for setting sensitivity of exposure to said signal from said document density detecting means in automatic exposure mode of operation, and exposure control means for controlling exposure on said photoreceptor according to said detected density by said document density detecting means and said sensitivity set by said sensitivity setting means, the improvement wherein said copier further comprises mode switching means for switching to test mode of operation, and sensitivity switching means for sequentially varying said sensitivity automatically in a plurality of steps by controlling said sensitivity setting means during a series of copying operations on one or more sheets of copy paper in said test mode of operation.

3. In a copier with a photoreceptor and exposure setting means for setting exposure on said photoreceptor manually or according to the density of a document to be copied, the improvement wherein said copier comprises mode switching means for switching to test mode of operation, and exposure switching means for sequentially varying exposure nearly continuously between a minimum value and a maximum value by controlling said exposure setting means during copying operation on one sheet of copy paper in said test mode of operation.

* * * * *